United States Patent [19]

Perradin

[11] Patent Number: 4,485,599

[45] Date of Patent: Dec. 4, 1984

[54] PROCESS FOR MAKING A FALSE CEILING AND FALSE CEILING MADE BY CARRYING OUT SAID PROCESS

[76] Inventor: Guy Perradin, Le Grand Logis, Guereins 01140 Thoissey, France

[21] Appl. No.: 475,581

[22] Filed: Mar. 15, 1983

[30] Foreign Application Priority Data

Mar. 18, 1982 [FR] France ..... 82 04801

[51] Int. Cl.[3] ..... E04B 5/57

[52] U.S. Cl. ..... 52/222; 181/295; 362/145; 362/290; 29/452; 160/196 R; 160/168 R; 52/741

[58] Field of Search ..... 181/293, 295; 362/290, 362/342, 355, 150, 145–149; 52/222, 484, 144, 145, 240, 261, 273, 63, 741, 745; 160/196 R, 196 D, 168, 378, 368 G, 327–329; 29/448, 452, 462

[56] References Cited

U.S. PATENT DOCUMENTS

| | | | |
|---|---|---|---|
| 2,503,441 | 4/1950 | Kamm | 160/196 |
| 2,527,031 | 10/1950 | Rambusch | 52/63 |
| 3,006,019 | 10/1961 | Deaton | 362/290 |
| 4,197,923 | 4/1980 | Harris et al. | 181/295 |
| 4,430,814 | 2/1984 | Wulc | 160/378 |

FOREIGN PATENT DOCUMENTS 1464883 3/1966 France .

*Primary Examiner*—James L. Ridgill, Jr.
*Attorney, Agent, or Firm*—Dowell & Dowell

[57] ABSTRACT

The present invention relates to a process for making false ceilings comprising a series of parallel strips of fabric of reduced width, reinforced transversely, tensioned longitudinally and oriented vertically in a mean horizontal plane located at an appropriate height below the ceiling of the construction, wherein each strip is tensioned individually and independently of those strips which surround it. The invention also relates to the false ceiling made by carrying out said process.

10 Claims, 7 Drawing Figures

PROCESS FOR MAKING A FALSE CEILING AND FALSE CEILING MADE BY CARRYING OUT SAID PROCESS

The present invention relates to false ceilings or so-called "technical" ceilings which, in the arrangement of stores or like premises, are frequently installed below the real ceiling of the construction and which are intended either to reduce the apparent height of the room in question whilst creating an upper volume forming a housing for the lighting, ventilation and sound installations, or to decorate the upper part of the premises or to correct the acoustic characteristics thereof.

It is a principal object of the invention to provide a process for making false ceilings of the above-mentioned type, which process consists in disposing a series of parallel strips of woven fabric of reduced width, reinforced transversely and oriented vertically in a horizontal plane located at an appropriate height below the real ceiling, and in longitudinally tensioning said strips between at least two fixed points of the premises.

According to a preferred embodiment of the above-mentioned arrangement, a woven fabric based on glass fibres is used, which proves particularly advantageous by reason of its characteristics of luminosity and non-inflammability and its silky appearance. The transverse edges of each of the strips are rendered fast with a reinforcement of polygonal section, introduced inside a tube which is slit longitudinally to allow the strip to pass; the wall of the opening of this tube is crenelated or presents a series of ratchet teeth so as to allow the strip to be tensioned by simple winding by force and to allow the tube and its winding to be automatically stopped, definitive immobilisation being effected with the aid of a transverse locking screw. Each tube bears an outwardly turned transverse rod in order to cooperate with one of two racks fixed opposite each other against two opposite walls of the premises; each rack is perforated with a series of openings regularly spaced apart to ensure restraint of the tubes of all the strips which form the false ceiling, each of these openings presenting a section in key-hole form with a view to facilitating assembly of the different tubes.

It will be appreciated that, between the two lateral racks, the strips of fabric tend to sag slightly despite their longitudinal tension. To avoid such sagging, which would be detrimental to the aesthetic appearance of the false ceiling, intermediate bearing elements are advantageously used which are oriented substantially transversely with respect to said strips. These bearing elements may be constituted by simple tensioned metal wires to which the strips are fixed with the aid of clips or other clamp elements.

Furthermore, it will be understood that the portion of the strips located between the two racks is capable of being guided, once or several times, by means of vertical bars fixed parallel to one another to the real ceiling of the premises; the strips of fabric then form an ornamental design in the upper part of the premises in question. In addition, it is obvious that each strip may be of any desired colour or may even have a decorative design or pattern printed thereon.

It will further be noted that, instead of being disposed strictly vertically, the strips of tensioned fabric may be oriented more or less obliquely, which allows new decorative effects to be obtained.

The invention also relates to the false ceilings obtained by carrying out the process mentioned above.

The invention will be more readily understood on reading the following description with reference to the accompanying drawings, in which:

FIG. 1 schematically illustrates, in perspective, the installation of a false ceiling according to the invention.

FIG. 2 shows on a larger scale, prior to assembly thereof, the pieces of the mechanisms ensuring stiffening, tensioning and fixation of the ends of the strips of the false ceiling according to FIG. 1.

FIG. 3 reproduces FIG. 2 after the pieces have been assembled.

Figure 1:
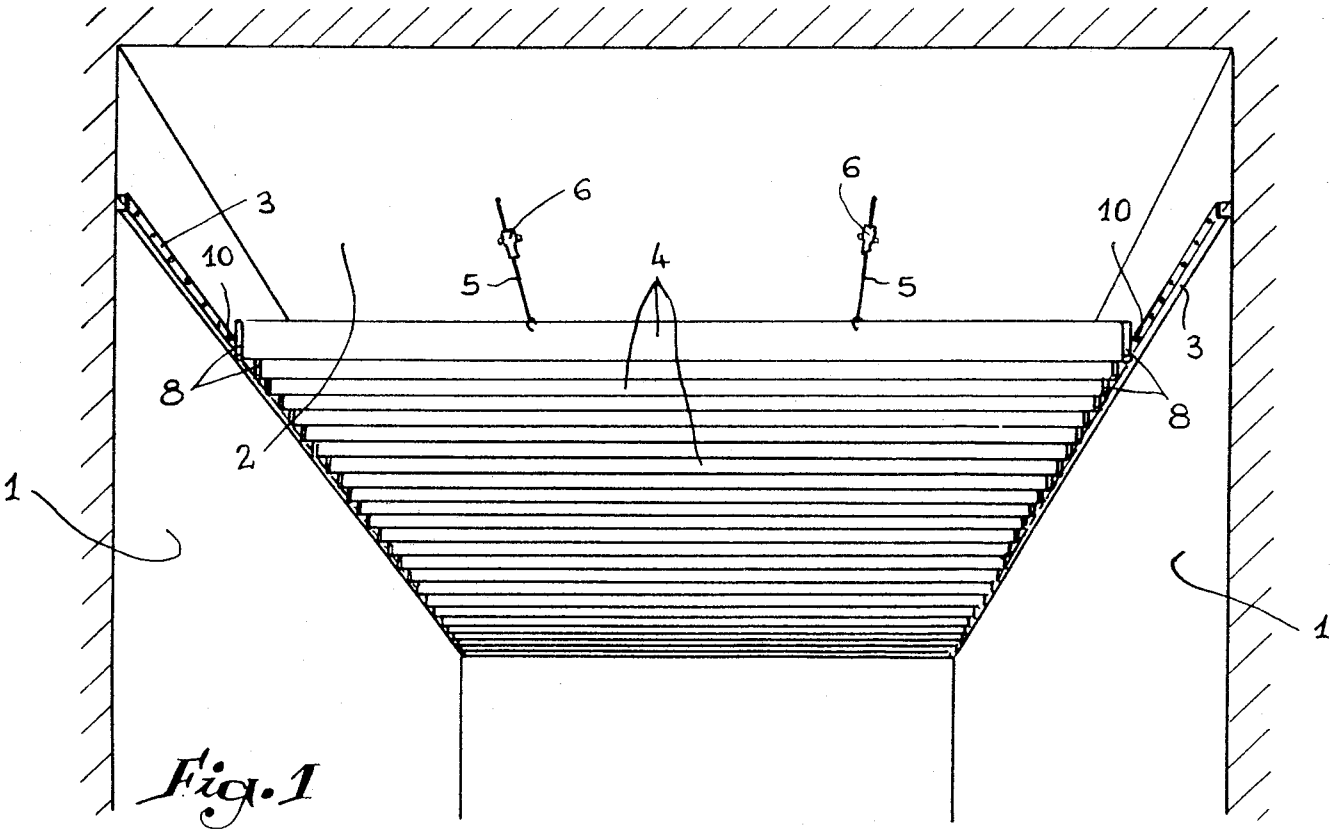

Referring now to the drawings, reference 1 in FIG. 1 denotes two opposite walls of commercial premises of which the ceiling has been indicated by reference 2. To make a false ceiling according to the invention in such premises, a horizontal section 3, arranged in the manner of a rack, is fixed against each wall 1, at the height desired for the false ceiling, in order to allow a series of strips of fabric 4, regularly spaced apart horizontally, to be assembled in the longitudinally tensioned state. Each strip 4, oriented in a vertical plane, is of reduced height (in practice, of the order of 10 to 20 cm) and comprises at each of its transverse edges a mechanism which ensures stiffening thereof and which makes it possible to tension it longitudinally prior to its being fixed against the rack 3 in question. Bearing wires 5, tensioned with the aid of conventional tension devices 6, and oriented transversely with respect to the strips 4, are disposed thereabove and are fixed thereto with the aid of appropriate fastenings, in order to avoid any sagging of said strips between the racks 3.

Figure 2:
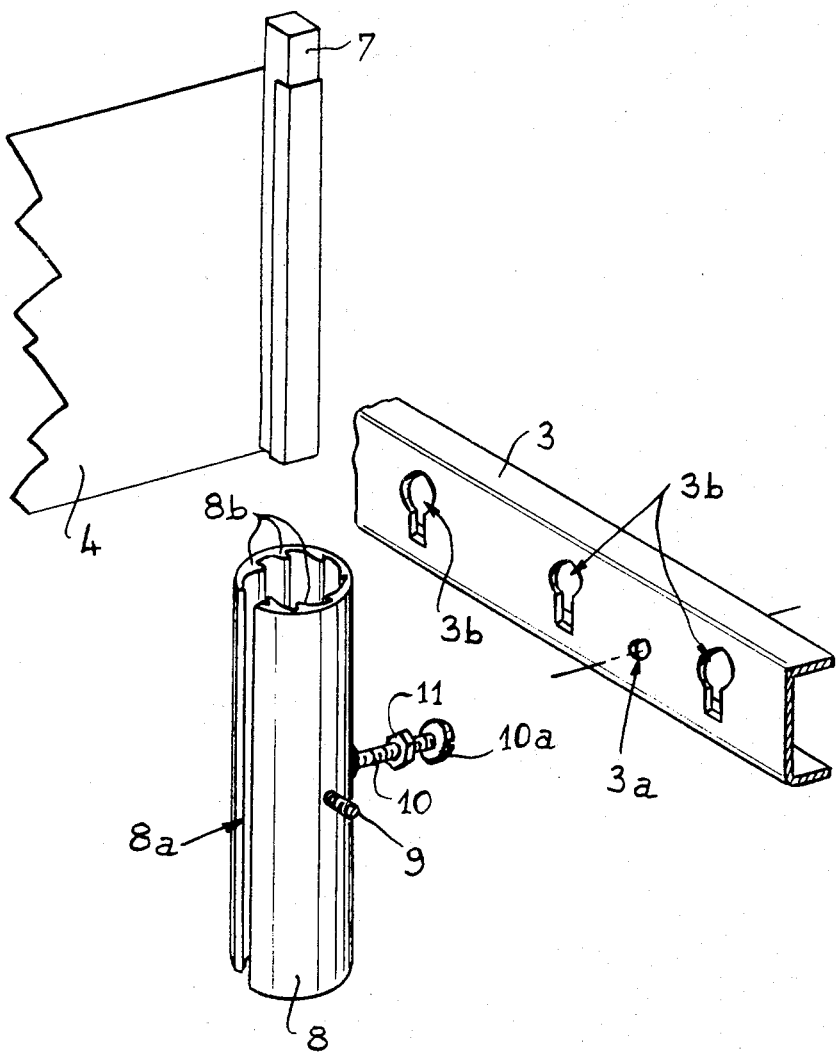
Figure 3:
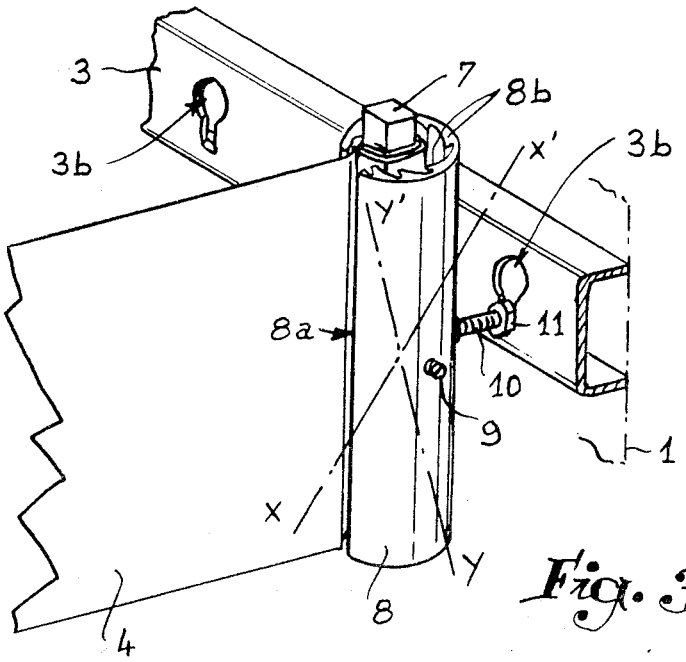
Figure 4:
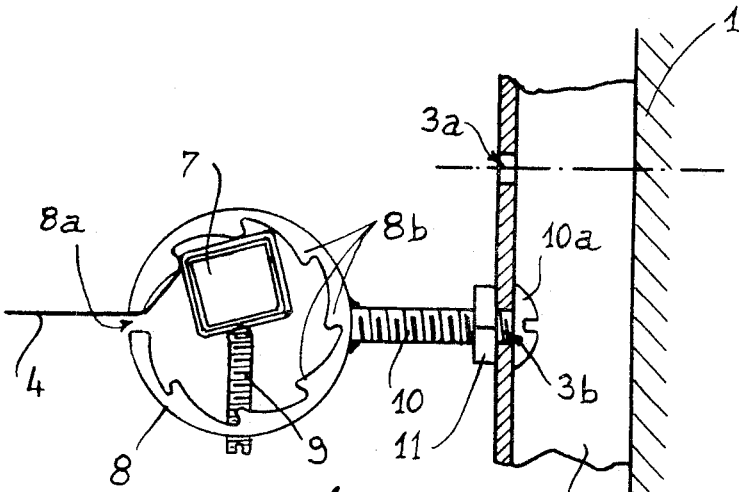
FIG. 4 is the corresponding horizontal section.

As shown in FIGS. 2 and 3, the mechanism provided at each end of each strip 4 comprises, on the one hand, a vertical reinforcement 7 rendered fast with the relevant free transverse edge of this strip, and, on the other hand, a tube 8 in which a longitudinal slit or opening **8*a* is cut out. The reinforcement 7, of square section in the embodiment envisaged, is adapted to be introduced with the strip 4 into the tube 8, the inner wall of the latter presenting a series of ratchet teeth 8*b*; once positioned in this tube 8, the reinforcement 7 may be manoeuvred in rotation in order to tension the strip 4 suitably by winding, it being observed that it obviously suffices to manoeuvre only one of the two mechanisms associated with each strip. When the maximum tension has been attained, the operator immobilizes the reinforcement 7 in the tube 8 by screwing a transverse screw 9 which applies said reinforcement against the teeth 8*b*, as illustrated in FIG. 4**.

Opposite its opening or slit **8*a*, each tube 8 bears a threaded rod 10 which is fixed radially thereto by welding and which is provided at its free end with an enlarged head 10*a*, adapted to be engaged in the upper, large-diameter part of an opening 3*b* in the form of a key-hole, made vertically in the corresponding rack 3. Each rack 3, pierced at 3*a* for the passage of the screws which fix it against the wall 1, presents a series of openings or key holes 3*b* regularly spaced along the central part of its U-section. After engagement of the head 10*a* in the lower, small-diameter part of the opening 3*b* in question, the rod 10 is locked with the aid of a nut 11** and the tubes 8, the sections 7 and the strips 4 of the false ceiling are thus capable of being immobilized, not only in the vertical orientation shown in FIG. 3, but also in more or less oblique orientations, such as those materialized by axes X—X' and Y—Y'.

Figure 7:
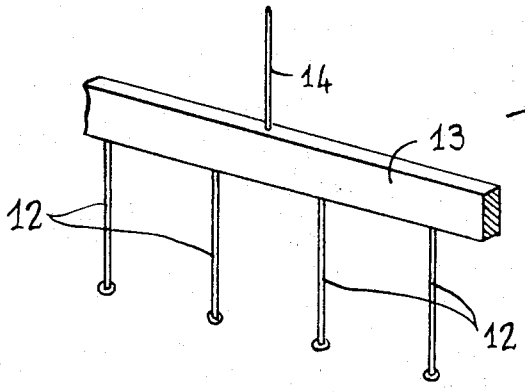
FIG. 7 shows in perspective a guide bar adapted to be used for making the false ceilings of FIGS. 5 and 6.
Figure 5:
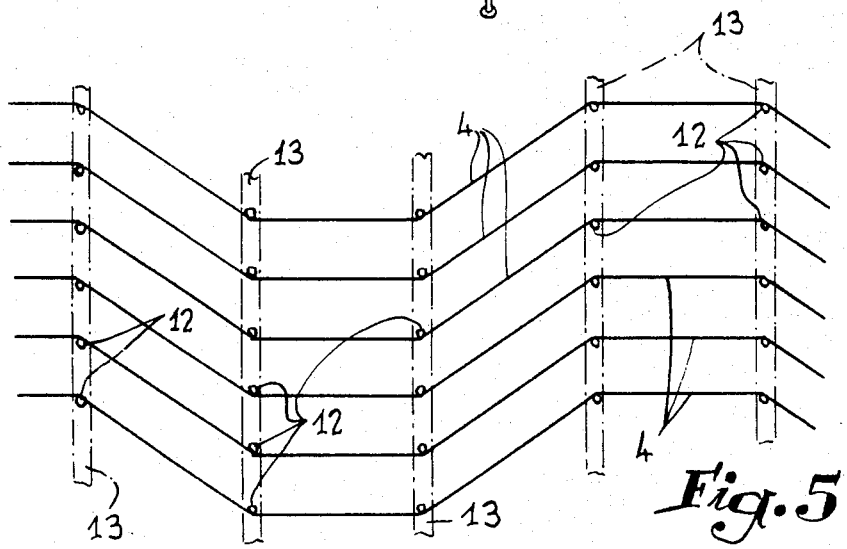
FIGS. 5 and 6 show two designs which may be obtained.
Figure 6:
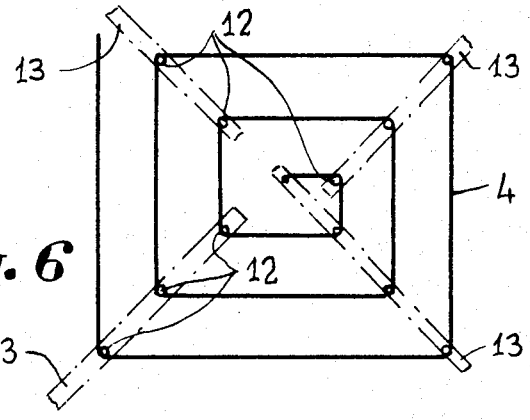

As indicated above, the strips 4 are not at all obliged to be disposed in rectilinear manner. FIGS. 5 and 6 show two variants in which the strips 4 of the false ceiling are guided to define a broken section, with the aid of vertical bars 12 (FIG. 7) carried by beams 13. The latter are fixed to the ceiling 2 of the construction with the aid of rods 14 which allow their height to be easily adjusted. It is obvious that any desired decorative design may be imagined.

It must be understood that the foregoing description has been given only by way of example and that it in no way limits the domain of the invention whose scope would not be exceeded by replacing the details of execution described by any other equivalents.

What is claimed is:

1. Process for making false ceilings comprising a series of parallel strips of fabric of reduced width, reinforced transversely, tensioned longitudinally and oriented vertically in a mean horizontal plane located at an appropriate height below the ceiling of the construction, comprising the step of tensioning each strip individually and independently of those strips which surround it.

2. The process of claim 1, wherein at least one intermediate bearing element, oriented substantially perpendicularly to the strips, is provided between the transverse edges of said strips, which are appropriately attached to this bearing element with a view to avoiding any sagging.

3. The process of claim 1, wherein, between the ends of the strips, said strips are guided with the aid of fixed vertical bars with a view to obtaining a particular design.

4. False ceiling made by a series of parallel strips of fabric of reduced width, reinforced transversely and oriented vertically in a mean horizontal plane located at an appropriate height below the ceiling of the construction, the ends of these strips being rendered fast with appropriate mechanisms adapted to ensure tensioning thereof between fixed points of the premises, wherein said false ceiling comprises an individual tensioning mechanism for each of these strips so that it can be tensioned independently of those which surround it.

5. The false ceiling of claim 4, wherein, between its ends, each of the strips is guided by at least one vertical bar appropriately fixed to the ceiling of the premises.

6. The false ceiling of claim 4, wherein each strip is formed by a glass fibre fabric.

7. The false ceiling of claim 4, in which devices are provided for transversely stiffening the strips and for fixing them to a wall, wherein the individual tensioning mechanism associated with at least one of the two ends of each strip simultaneously stiffens the end in question, tensions it longitudinally and fixes it.

8. The false ceiling of claim 7, wherein the mechanism comprises, on the one hand, a reinforcement rendered fast with the free transverse edge of the strip in question and, on the other hand, a longitudinally slit tube adapted to receive said reinforcement, which tube is provided with means adapted to allow it to be fixed against the wall.

9. The false ceiling of claim 8, wherein the inner wall of the tube presents a series of ratchet teeth whilst the reinforcement is of polygonal section, the tube being provided with a radial locking screw adapted to ensure angular immobilization of the reinforcement once the longitudinal tension is obtained.

10. The false ceiling of claim 8, wherein each tube is provided with a radial rod whose enlarged head is adapted to be engaged and retained in one of a series of keyhole-shaped openings made at regular intervals in a rack connected to one of the walls of the premises, a locking nut enabling the tube to be angularly immobilized at any desired orientation.

* * * * *